US009305698B2

(12) United States Patent
Takagi et al.

(10) Patent No.: US 9,305,698 B2
(45) Date of Patent: Apr. 5, 2016

(54) COIL COMPONENT

(71) Applicant: TDK Corporation, Tokyo (JP)

(72) Inventors: Nobuo Takagi, Tokyo (JP); Setu Tsuchida, Yamagata (JP); Tasuku Mikogami, Tokyo (JP); Satoru Sariishi, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 14/475,183

(22) Filed: Sep. 2, 2014

(65) Prior Publication Data

US 2015/0061811 A1 Mar. 5, 2015

(30) Foreign Application Priority Data

Sep. 3, 2013 (JP) ..... 2013-182084

(51) Int. Cl.
*H01F 27/29* (2006.01)
*H01F 27/24* (2006.01)

(52) U.S. Cl.
CPC ..... *H01F 27/292* (2013.01)

(58) Field of Classification Search
CPC ..... H01F 27/29; H01F 27/292; H01F 17/045
USPC ..... 336/212, 192, 83
See application file for complete search history.

(56) References Cited

U.S. PATENT DOCUMENTS 6,027,008 A * 2/2000 Toi et al. ..... 228/110.1
2008/0003864 A1* 1/2008 Hatakeyama et al. ..... 439/399
2009/0219127 A1* 9/2009 Tomonari ..... H01F 27/29 336/192

FOREIGN PATENT DOCUMENTS

JP 2009-117627 5/2009

* cited by examiner

*Primary Examiner* — Mangtin Lian
(74) *Attorney, Agent, or Firm* — Young Law Firm, P.C.

(57) ABSTRACT

A coil component is provided with a coil, a base supporting the coil having a first surface parallel to an extending direction of the terminal section of the coil, and a terminal electrode having a first terminal portion printed on the first surface of the base. The first surface has a stepped surface including an upper stage surface and a lower stage surface. The first terminal portion has a stepped shape including an upper stage portion formed on the upper stage surface and a lower stage portion formed on the lower stage surface. The upper stage portion has a first terminal surface contacting the terminal section of the coil. The lower stage portion has a second terminal surface positioned on an extension line of the terminal section of the coil and not contacting the terminal section of the coil.

21 Claims, 9 Drawing Sheets

COIL COMPONENT

BACKGROUND OF THE INVENTION

1. Field of the Invention

The present invention relates to a coil component and, more particularly, to a terminal electrode structure of a surface-mount type coil component.

2. Description of Related Art

Along with recent miniaturization of electronic devices, a coil component is required to foe mounted in high density, as other components are required to do so. For example, Japanese Patent Application Laid-Open No. 2009-117627 discloses a surface-mount type coil component capable of achieving high density mounting.

This coil component includes a core having a winding core and flanges, an insulating case in which an accommodation space for accommodating the core is formed, a terminal electrode made of a metal fitting and mechanically fixed to the case in a state where at least a part thereof is exposed outside, and a winding (wire) connected to the terminal electrode and wound, around the winding core via the case. The accommodation space for the core is defined by including a bottom surface substantially parallel with a mounting surface. The winding core and flange have a lower surface of the winding core and a lower surface of the flange, respectively, which are opposed to the bottom surface of the case. The lower surface of the winding core is in the same plane as the lower surface of the flange. A leg portion protruding toward the mounting surface is defined in a position opposite to the flange of the case, and a mounting portion of the terminal electrode is arranged in the leg portion.

In the above-described coil component, the wire end terminal electrode are connected in such that a leading end section of the wire is thermocompression-bonded on the terminal electrode. When the wire is thermocompression-bonded on the terminal electrode, a material (Cu) of the wire and a plating film (Ni and Sn) on a surface of the terminal electrode react with each other to form an alloy layer. The alloy layer has a high melting point, so that when a portion of the alloy layer serves as a solder bonding surface upon mounting of the coil component on a circuit board, solder wettability may be lowered. Particularly, as illustrated in FIG. 9A, when a leading end section 20*e* of a wire 20 to be thermocompression-bonded is made to be aligned to an end portion of a terminal, surface of a terminal electrode 21, the alloy layer is formed from end to end of the terminal surface in a wire extending direction, that is, formed over a wide area of the terminal surface and, at the same time, a plating thickness of a side electrode is reduced, which may inhibit formation of a solder fillet to cause mounting failure.

To solve this problem, as illustrated in FIG. 9B, the leading end section 20*e* of the wire 20 is made to be aligned not to the end portion of the terminal surface of the terminal electrode 21, but to a position (in the vicinity of a center of the terminal surface) inward from the end portion. In this case, the wire 20 led out from the winding core of the core passes the terminal surface of the terminal electrode 21 to be led frontward thereof in the wire extending direction. Then, a wire section (section denoted by a continuous line) located rearward (in the wire extending direction) of a position to be set as the wire leading portion is thermocompression-bonded, and a front wire section (section denoted by a dashed line) in the wire extending direction is out for removal. However, if the front wire section is brought into contact with the terminal surface of the terminal electrode 21, the wire is disadvantageously fixed to the surface of the terminal electrode 21 due to melting of the plating film on the surface of the terminal electrode by heat generated upon the thermocompression bonding, making it difficult to cut and remove the front wire section. Such a problem occurs not only when the metal fitting is used as the terminal electrode, but also when a printed electrode is used as the terminal electrode, and there is required a countermeasure against this problem.

SUMMARY

To solve the above problem, a coil component according to the present invention includes a coil having a winding wire, a base supporting the coil, and a terminal electrode to which a terminal section of the coil is connected. The base has a first surface parallel to an extending direction of the terminal section of the coil. The terminal electrode has a first terminal portion printed on the first surface of the base. The first surface has a stepped surface including an upper stage surface and a lower stage surface. The first terminal portion has a stepped shape including an upper stage portion formed on the upper stage surface and a lower stage portion formed on the lower stage surface. The upper stage portion has a first terminal surface contacting the terminal section of the coil. The lower stage portion has a second terminal surface positioned on an extension line of the terminal portion and not contacting the terminal section of the coil.

According to the present invention, upon thermocompression bonding, the terminal portion of the wire is thermocompression-bonded only onto the first terminal surface of the first terminal portion of the terminal electrode and is not thermocompression-bonded onto the second terminal surface, preventing an alloy layer from being formed in a wide area. This prevents formation of a solder fillet from being inhibited due to existence of the alloy layer. Further, it is possible to reliably and easily cut and remove the wire after the thermocompression bonding.

In the present invention, it is preferable that the base has a second surface perpendicular to the first surface, the terminal electrode is formed into an L-shape and has a second terminal portion printed on the second surface of the base, and the second terminal portion is connected to the lower stage portion of the first terminal portion. With this configuration, the lower stage portion of the first terminal portion is not alloyed upon thermocompression bonding of the wire terminal section, so that it is possible to prevent a situation in which the solder fillet is hardly formed on the second terminal portion due to influence of alloying of the first terminal portion.

In the present invention, it is preferable that the base is a drum core having a winding core around which the coil is wound and a pair of flanges provided at both ends of the winding core, and the terminal electrode is formed on each of the flanges. With this configuration, in a surface-mount type coil component using the drum core, wettability of a solder on the terminal surface to which the wire is connected can be enhanced, thereby enhancing reliability of the coil component in terms of electrical and mechanical connection.

According to the present invention, an unnecessary section of the wire after thermocompression bonding can be reliably cut and easily removed. Thus, a coil component having a terminal surface with satisfactory solder wettability can be achieved.

BRIEF DESCRIPTION OF THE DRAWINGS

The above and other objects, features and advantages of this invention will become more apparent by reference to the following detailed description of the invention taken in corn auction with the accompanying drawings, wherein.

DETAILED DESCRIPTION OF THE EMBODIMENTS

Preferred embodiment of the present invention will be described hereinafter in detail with reference to the accompanying drawings.

Figure 1:
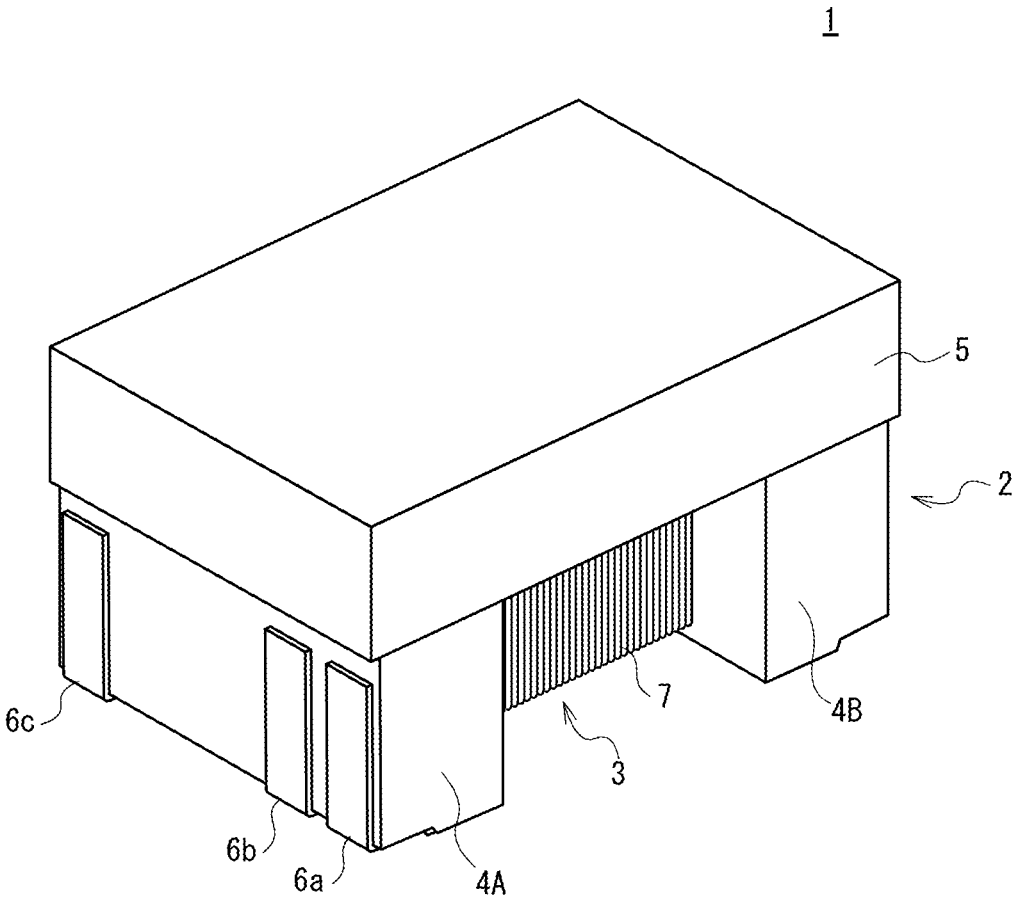
FIG. 1 is a schematic perspective view illustrating an enter appearance of a surface-mount type coil component according to a first embodiment of the present invention.
Figure 2:
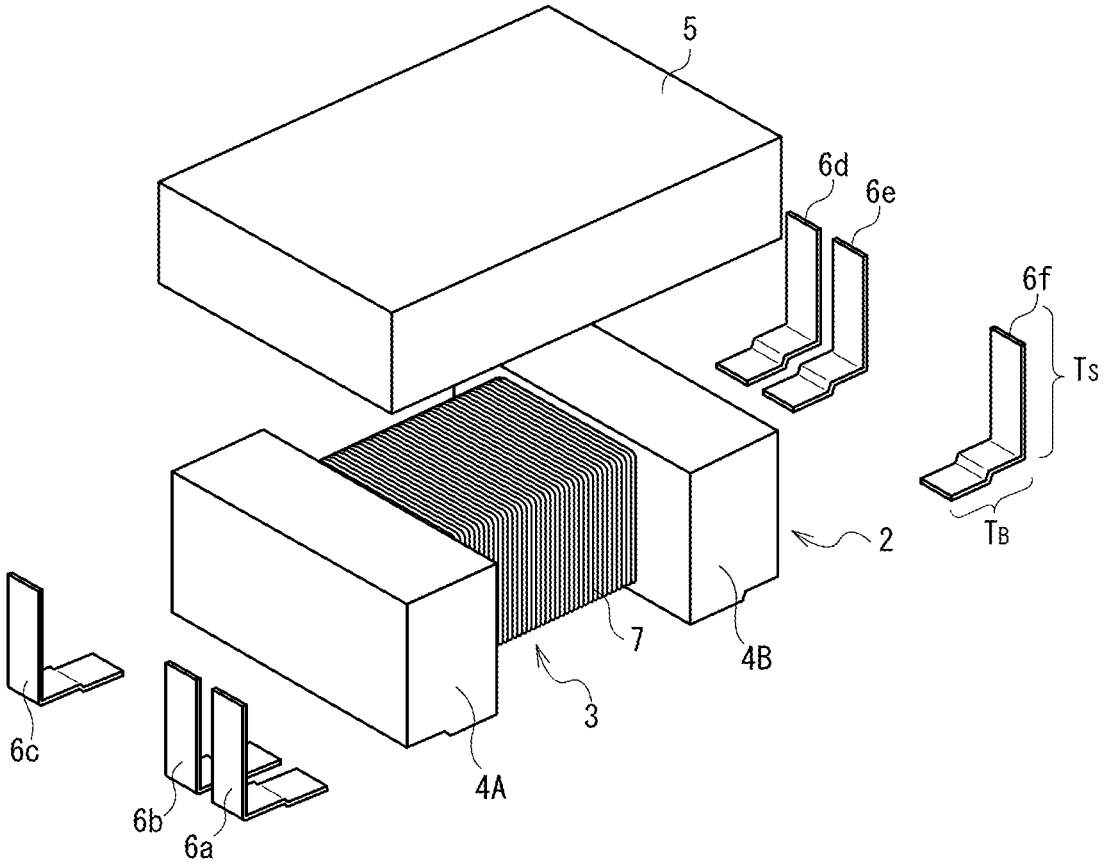
FIG. 2 is an exploded perspective view of the coil component of FIG. 1.

FIG. 1 is a schematic perspective view illustrating an outer appearance of a surface-mount type coil component according to a first embodiment of the present invention. FIG. 2 is an exploded perspective view of the coil component of FIG. 1, and FIG. 3 is a schematic perspective view obtained by turning upside down the coil component of FIG. 1.

Figure 3:
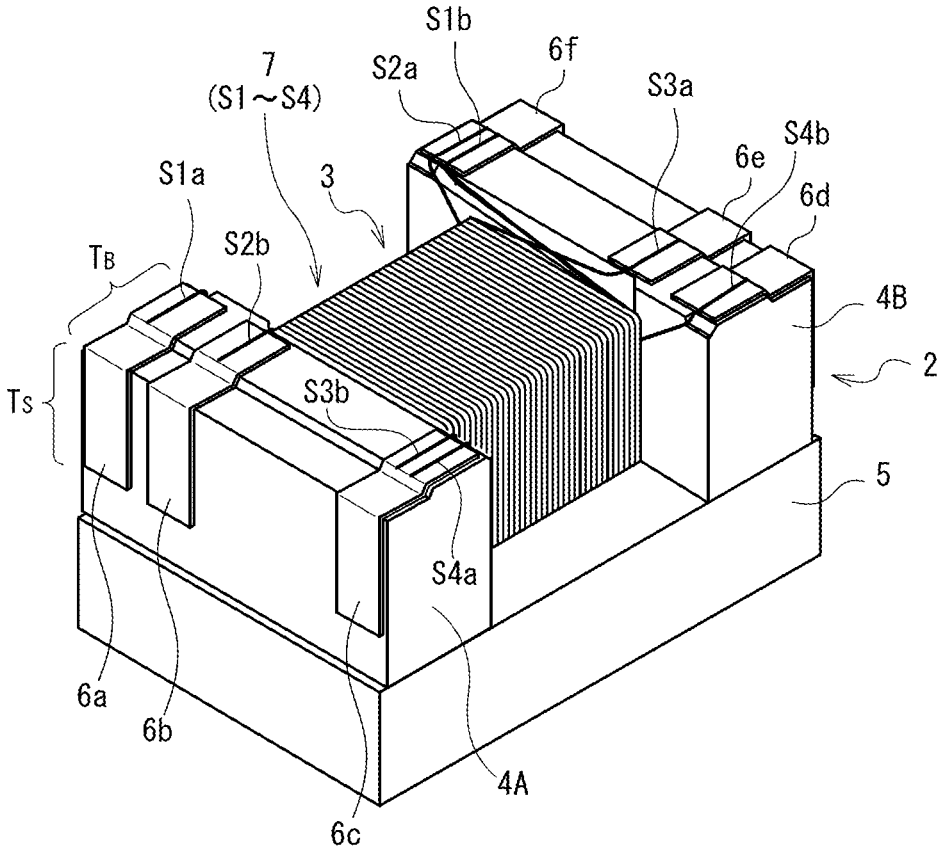
FIG. 3 is a schematic perspective view obtained by turning upside down the coil component of FIG. 1.

As illustrated in FIGS. 1 to 3, a coil component 1 includes a drum core 2, a plate core 5, six terminal electrodes 6*a* to 6*f* and coils 7 composed of wires wound around the drum core 2. Although not especially limited, the coil component 1 is a surface-mount type pulse transformer and has a size of about 4.5 mm×3.2 mm×2.6 mm.

The drum core 2 is made of a magnetic material such as Ni—Zn based ferries and includes a winding core 3 around which the coils 7 are wound and a pair of flanges 4A and 4B located at both ends of the winding core 3. The plate core 5 is also made of a magnetic material such as Ni—Zn based ferrite. The plate core 5 is placed on upper surfaces of the respective flanges 4A and 4B and fixed thereto by adhesive or the like.

An upper surface of the plate core 5 is a flat smooth surface, so that the smooth surface can be used as an adsorption surface upon mounting of the coil component 1. Further, a surface of the plate core 5 to be bonded to upper surfaces of the flanges 4A and 4B is preferably a smooth surface. Abutment of the smooth surface of the plate core 5 against the flanges 4A and 4B allows the plate core 5 and flanges 4A and 4B to be securely adhered with each other, thereby forming a closed magnetic path free from magnetic leakage.

The terminal electrodes 6*a* to 6*f* are each an L-shaped printed electrode extending from a bottom surface of the flange 4A or 4B to an outer side surface thereof. The outer side surface of the flange refers to a surface positioned at an opposite side to a mounting surface for the winding core 3. The terminal electrodes 6*a* to 6*f* can be formed by applying a conductive paste and then firing the conductive paste followed by sequential formation of Ni and Sn plating films.

Three terminal electrodes 6*a*, 6*b*, 6*c* are provided at the flange 4A side, and the remaining three terminal electrodes 6*d*, 6*e*, 6*f* are provided at the flange 4B side. At the flange 4A side, two terminal electrodes 6*a* and 6*b* are provided at a right side of the flange 4A, terminal electrode 6*c* is provided at a left side thereof, and a certain insulating clearance is provided between the two terminal electrodes 6*a*, 6*b* and terminal electrode 6*c*. Similarly, at the flange 4B side, two terminal electrodes 6*d* and 6*e* are provided at a right side of the flange 4B, terminal electrode 6*f* is provided at a left side thereof, and a certain insulating clearance is provided between the two terminal electrodes 6*d*, 6*e* and terminal electrode 6*f*.

As illustrated in FIG. 2, the L-shaped terminal electrodes 6*a* to 6*f* each include a bottom surface portion $T_B$ (first terminal portion) contacting the bottom surface (first surface) of the flange 4A or 4B and a side surface portion $T_S$ (second terminal, portion) contacting the outer side surface (second surface) of the flange 4A or 4B. As illustrated in FIG. 3, terminal sections of the coils 7 are thermocompression-bonded onto surfaces of the bottom surface portions $T_B$ of the terminal electrodes 6*a* to 6*f*, respectively.

Figure 4:
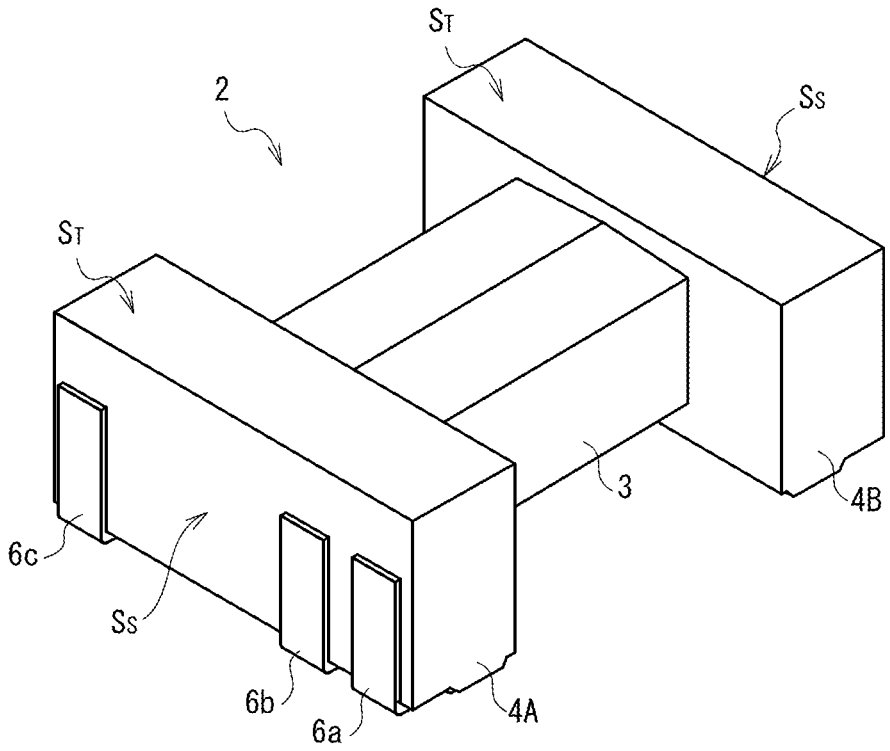
FIG. 4 is a schematic perspective view illustrating a configuration of the drum core 2 in a state where the terminal electrodes 6*a* to 6*f* are provided thereon.
Figure 5:
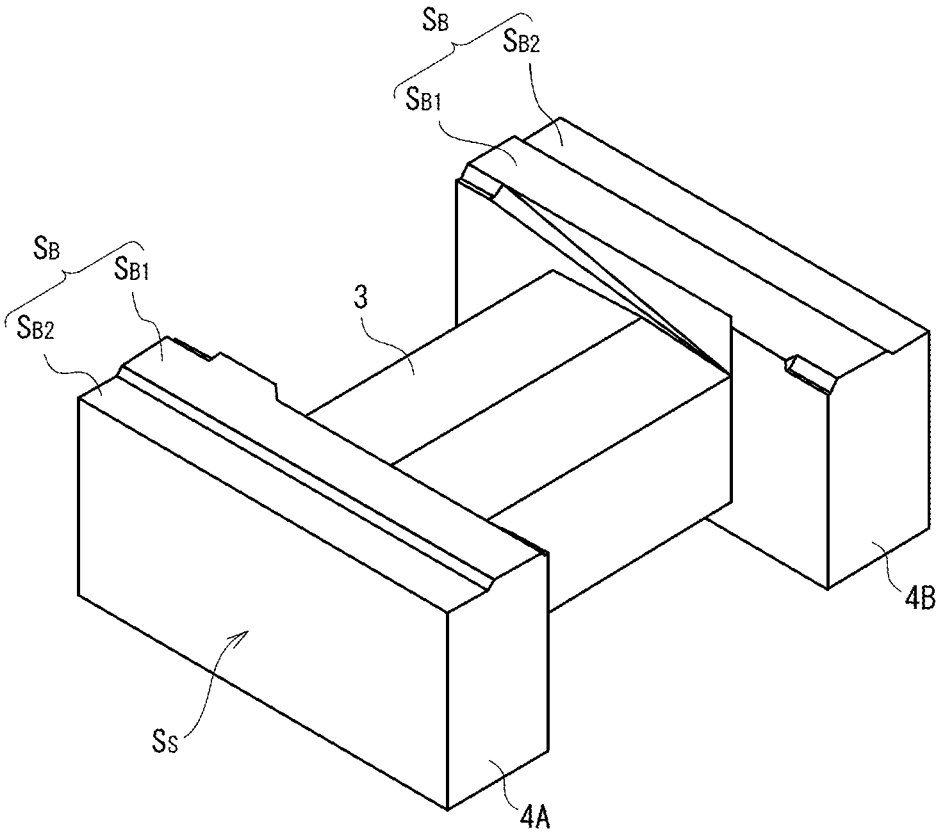
FIG. 5 is a schematic perspective view obtained by turning upside down the drum core 2 of FIG. 4, which illustrates a state where the terminal electrodes 6*a* to 6*f* are not provided thereon.
Figure 6A:
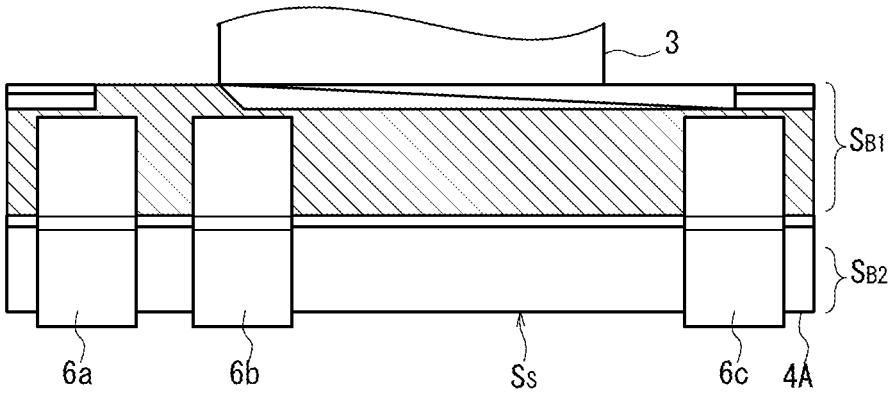
FIG. 6A is a schematic plan view of the flange 4A as viewed from the bottom thereof.

FIG. 4 is a schematic perspective view illustrating a configuration of the drum core 2 in a state where the terminal electrodes 6*a* to 6*f* are provided thereon. FIG. 5 is a schematic perspective view obtained by turning upside down the drum core 2 of FIG. 4, which illustrates a state where the terminal electrodes 6*a* to 6*f* are not provided thereon. FIG. 6A is a schematic plan view of the flange 4A as viewed from the bottom thereof, and FIG. 6B is a schematic plan view of the flange 4A as viewed from the outer side surface side thereof.

As illustrated in FIGS. 4 and 5, the drum core 2 includes the winding core 3 and pair of flanges 4A and 4B located at the both ends of the winding core 3. The drum, core 2 has a rotationally symmetric shape in a plan view. The flanges 4A and 4B have the same shape, so that in FIG. 6, only the flange 4A is illustrated, and the illustration of the flange 4B is omitted.

As illustrated in FIG. 4, each upper surface $S_T$ of the flanges 4A and 4B is a smooth flat surface, which enhances adhesion with the plate core 5. As described above, the plate core 5 is bridged between the upper surfaces $S_T$ of the flanges 4A and 4B, whereby a substantial closed magnetic path is formed.

Figure 6B:
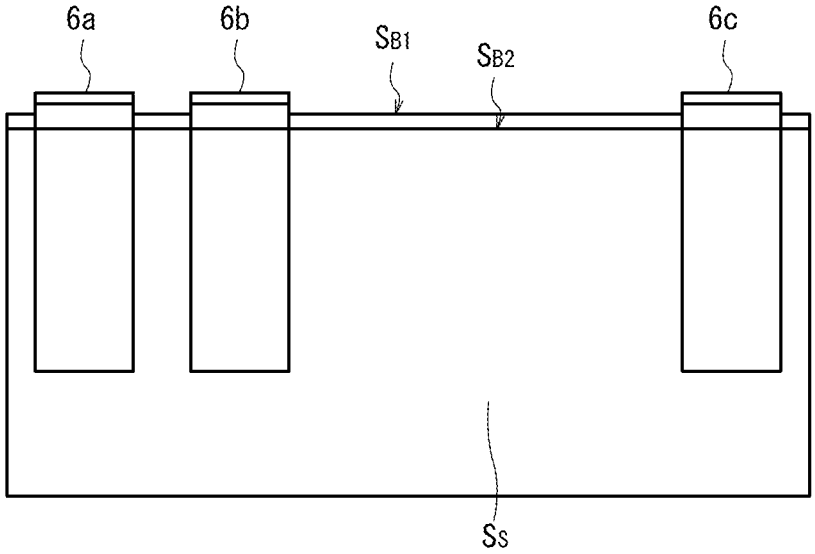
FIG. 6B is a schematic plan view of the flange 4A as viewed from the outer side surface side thereof.

As illustrated in FIGS. 4, 5, and 6B, each outer side surface $S_S$ of the flanges 4A and 4B is a flat surface. On the other hand, as illustrated in FIGS. 5 and 6A, each bottom surface $S_B$ of the flanges 4A and 4B has a stepped surface in which an installation area for the terminal electrodes 6*a* to 6*f* on a base end side thereof is formed higher in height than an installation area for the terminal electrodes 6*a* to 6*f* on a leading end side thereof. More specifically, upper stage surfaces $S_{B1}$ are formed near inner side surfaces of the respective flanges 4A and 4B, and lower stage surfaces $S_{B2}$ are formed near outer side surfaces $S_S$ thereof. In the present embodiment, the upper stage surfaces $S_{B1}$ and lower stage surfaces $S_{B2}$ are formed over the entire bottom surfaces $S_B$ of the flanges 4A and 4B in a longitudinal direction thereof (entire areas of the respective flanges 4A and 4B in a width direction thereof). The base end side of the bottom surface portion $T_B$ of each of the terminal electrodes 6*a* to 6*f* is provided on the upper stage surface $S_{B1}$ of the bottom surface $S_B$ of the flange 4A or 4B, and a corner side of the bottom surface portion $T_B$ of each of the terminal electrodes 6*a* to 6*f* is provided on the lower stage surface $S_{B2}$ of the bottom surface $S_B$ of the flange 4A or 4B. In FIG. 6A, a hatched area is the upper stage surface $S_{B1}$ and an unhatched area is the lower stage surface $S_{B2}$.

Figure 7A:
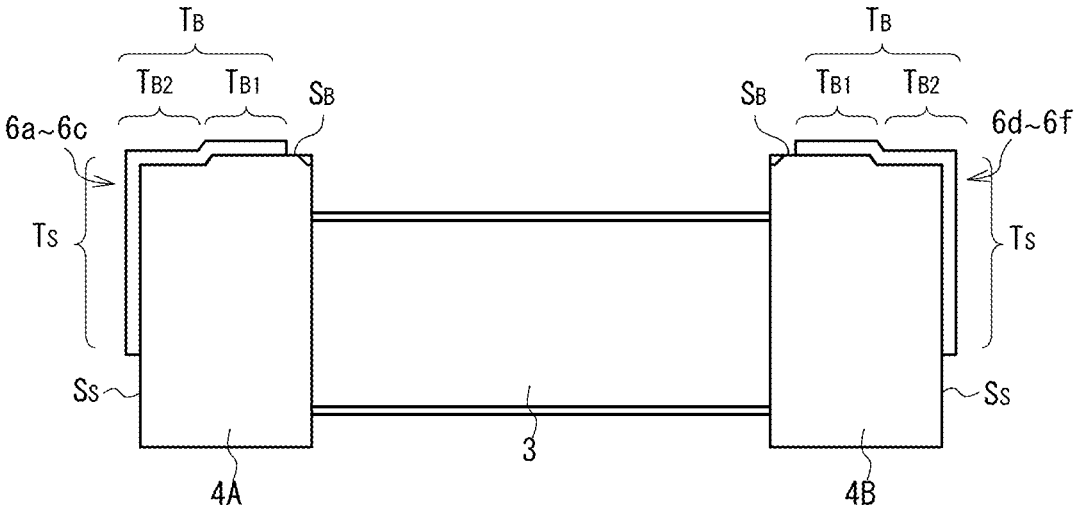
FIG. 7A is a schematic side cross-sectional view illustrating a shape of each of the terminal electrodes 6*a* to 6*f* provided on the flange 4A or 4B.
Figure 7B:
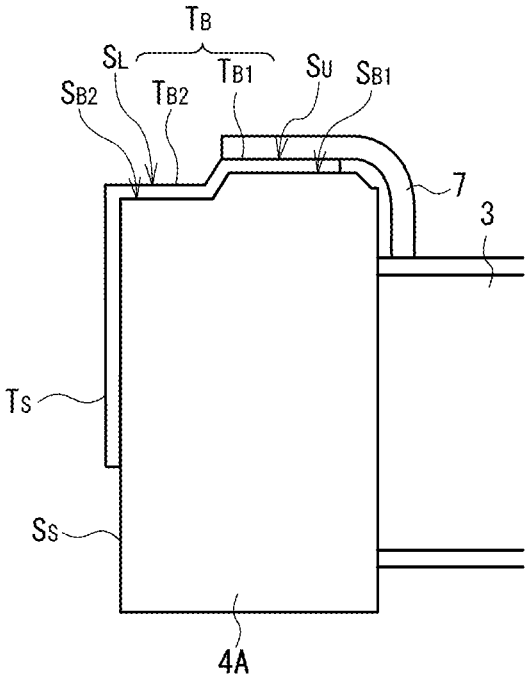
FIG. 7B is a partially enlarged view of the terminal electrode on the flange 4A side.

FIGS. 7A and 7B are schematic side cross-sectional views illustrating a shape of each of the terminal electrodes 6*a* to 6*f* provided on the flange 4A or 4B. FIG. A is a schematic side view including the entire drum core, and FIG. 7B is a partially enlarged view of the terminal electrode on the flange 4A side. A configuration on the flange 4B side is the same as that on the flange 4A side.

As illustrated in FIGS. 7A and 7B, the bottom and side surface portions $T_B$ and $T_S$ of each of the L-shaped terminal electrodes 6*a* to 6*f* are provided respectively on the bottom surface $S_B$ (first surface) and outer side surface $S_S$ (second surface) of the flange 4A or 4B. The bottom surface $S_B$ of each of the flanges 4A and 4B has the stepped surface, and the bottom surface portion $T_B$ of each of the terminal electrodes 6*a* to 6*f* has a stepped shape corresponding to the stepped surface of the bottom surface $S_B$ of each of the flanges 4A and 4B.

The bottom surface portion $T_B$ of each of the terminal electrodes 6*a* to 6*f* includes an upper stage portion $T_{B1}$ formed near the inner side surface (near the winding core 3) of the flange 4A or 4B and a lower stage portion $T_{B2}$ formed near the outer side surface $S_S$ of the flange 4A or 4B. The side surface portion $T_S$ is connected to the lower stage portion $T_{B2}$ of the bottom surface portion $T_B$. The upper stage portion $T_{B1}$ serves as a portion providing a terminal surface (first terminal surface $S_U$) contacting the terminal section of the coil 7, and the lower stage portion $T_{B2}$ serves as a portion providing a terminal surface (second terminal, surface $S_L$) not contacting the terminal section of the coil 7. That is, the second, terminal surface $S_L$ of the lower stage portion $T_{B2}$ and first terminal surface $S_B$ of the upper stage portion $T_{B1}$ do not form the same plane.

The first terminal surface $S_U$ of the bottom surface portion $T_B$ of each of the terminal electrodes 6*a* to 6*f* provides a "press-contact surface" that receives press-contact force from the terminal section of the coil 7 upon thermocompression bonding. The second terminal surface $S_L$ of the bottom surface portion $T_B$ of each of the terminal electrodes 6*a* to 6*f* provides a "non press-contact surface" that releases press-contact force from the terminal section of the coil 7. The bottom surface portion $T_B$ of each of the terminal electrodes 6*a* to 6*f* has the stepped surface constituted by the first terminal surface $S_U$ and second terminal surface $S_L$, making it possible to prevent the terminal section of the coil 7 from being thermocompression-bonded over the entire width of the coil in the extending direction on the bottom surface portion of each of the terminal electrodes 6*a* to 6*f*. This allows an area where the alloy layer caused due to reaction between the wire and plating film is not formed to be secured widely, making it possible to reliably and easily cut and remove the wire.

Figure 8A:
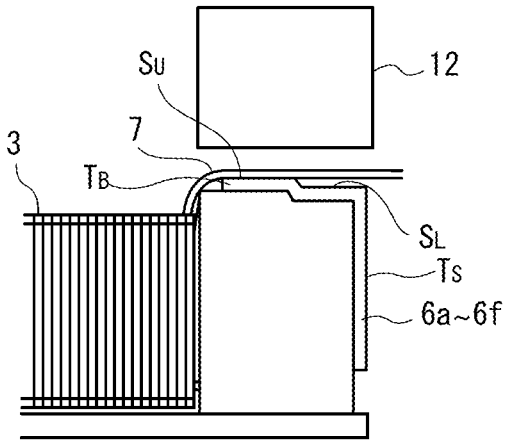
FIGS. 8A to 8C are exemplary views for explaining a thermocompression bonding process of the terminal section of the coil 7.
Figure 8B:
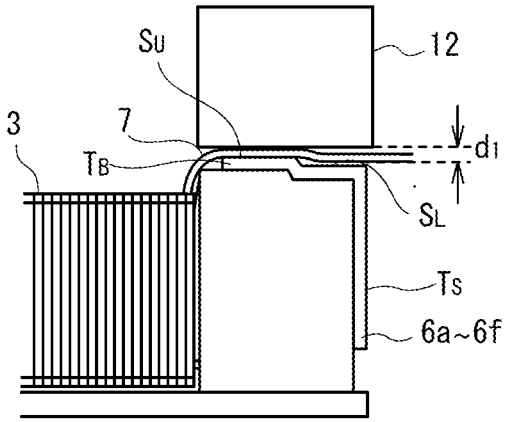
Figure 8C:
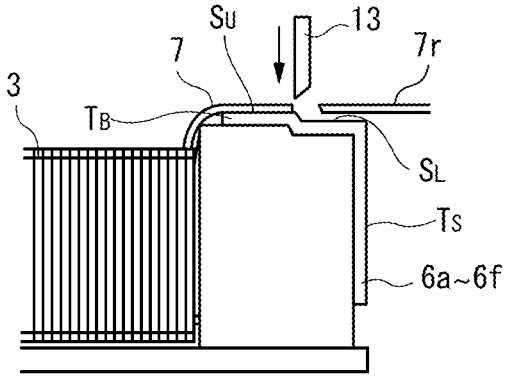
Figure 9A:
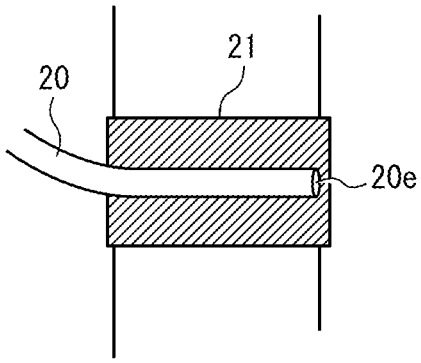
FIGS. 9A and 9B are schematic diagrams for explaining a conventional coil component.
Figure 9B:
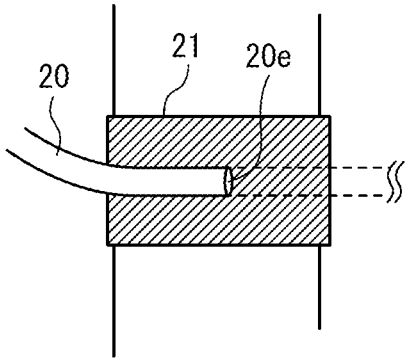

FIGS. 8A to 8C are exemplary views for explaining a thermocompression bonding process of the terminal section of the coil 7.

In the thermocompression bonding process, as illustrated in FIG. 8A, the terminal section of the coil 7 wound around the winding core 3 of the drum core 2 is wired on corresponding one of the terminal electrodes 6*a* to 6*f*. The terminal section of the coil 7 passes the corresponding terminal electrode and extends in parallel to the bottom surface of the flange 4A or 4B to be led to an outside of the flange 4A or 4B.

Then, as illustrated in FIG. 8B, a heater chip 12 is used to thermocompression bond the terminal section of the coil 7 onto the corresponding one surface of the terminal electrodes 6*a* to 6*f*. The wire section located above the first terminal surface $S_U$ of the bottom surface portion $T_B$ of each of the terminal electrodes 6*a* to 6*f* is sandwiched between the heater chip 12 and first terminal surface $S_U$ to foe pressed against the terminal surface by press-contact force of the high-temperature heater chip 12, with the result that the material (Cu) of the wire and plating film (Ni and Sn) of the terminal surface are alloyed to obtain sufficient bonding force.

On the other hand, the wire section located above the second terminal surface $S_L$ of the bottom surface portion $T_B$ of each of the terminal electrodes 6*a* to 6*f* enters a gap $d_1$ between the heater chip 12 and second terminal surface $S_L$. Thus, unlike the first terminal surface $S_U$, sufficient press-contact force is not applied to the second terminal surface $S_L$. As a result, thermocompression bonding of this wire section onto the second terminal surface $S_L$ can be avoided.

As illustrated in FIG. 8C, the terminal section of the coil 7 thus thermocompression-bonded onto the corresponding one of the terminal electrodes 6*a* to 6*f* is cut by a cutter 13 to be adjusted in length. At this time, the coil 7 is cut at a position around the stepped portion formed on the corresponding one of the terminal electrodes 6*a* to 6*f*. Upon cutting of the terminal section of the coil 7, an extra wire section 7*r* of the wire that has not been subjected to thermocompression boding is not fixed to the terminal surface. If the extra wire section 7*r* is fixed to the terminal surface by the plating film melted upon thermocompression bonding, fixing force therebetween is weak, so that the extra wire section 7*r* can be separated from the terminal surface by application of slight force. As a result, the wire is thermocompression-bonded only onto the first terminal surface $S_U$ out of the surface of the bottom surface portion $T_B$ of the terminal electrode, while the wire is not present on the second terminal surface $S_L$.

On the first terminal surface $S_U$, an area around the wire is lowered in solder wettability; however, there exists an area that has not been alloyed around the low solder wettability area, which contributes to solder connection. On the other hand, on the second terminal surface $S_L$, the wire is not present and thus has not been alloyed, so that satisfactory solder wettability is obtained.

The second terminal surface is a portion contacting the side surface portion $T_S$ of the terminal electrode and contributing, together with the side surface portion $T_S$, to formation of a solder fillet upon surface mounting. The second terminal surface $S_L$ not alloyed, so that it is possible to prevent a situation in which the Sn plating film on the side surface portion $T_S$ is melted by heat upon the thermocompression bonding to flow to the bottom surface portion $T_B$ side to result in reduction in thickness of the side surface portion $T_S$. Thus, when the coil component 1 having the configuration described above is surface-mounted, the solder wettability with respect to the terminal electrodes 6*a* to 6*f* can be enhanced, and the solder fillet can be reliably formed from the lower stage portion $T_{B2}$ to side surface portion $T_S$. Thus, reliability of the coil component 1 in terms of electrical and mechanical connection can be enhanced.

As described above, the coil component 1 according to the present embodiment has a configuration in which the stepped surface is formed on the terminal surface of each of the terminal electrodes 6*a* to 6*f* to which the terminal section of the coil is connected so as to prevent the terminal surface from contacting the leading end section of the coil 7, thereby preventing the leading end of the wire from being thermocompression-bonded onto the terminal surface, which in turn makes it possible to reliably and easily cut and remove the wire after the thermocompression bonding. Further, it is possible to prevent reduction in the plating thickness of the side surface portion $T_S$ upon thermocompression bonding, which in turn prevents formation of the solder fillet from being inhibited.

It is apparent that the present invention is not limited to the above embodiments, but may be modified and changed without departing front the scope and spirit of the invention.

For example, although a lateral drum core including the winding core around which the coil is wound and pair of flanges provided at the both ends of the winding core is used as a base in the above embodiment, so-called a vertical drum core may be used. The number of the terminal electrodes to be mounted is not especially limited. Thus, for example, four terminal electrodes may be formed on each of the flanges 4A and 4B.

What is claimed is:

1. A coil component comprising:

a coil having a winding wire;

a base supporting the coil; and a terminal electrode to which a terminal section of the coil is connected, wherein the base has a first surface substantially parallel to an extending direction of the terminal section of the coil, the terminal electrode has a first terminal portion printed, on the first surface of the base, the first surface has a stepped surface including an upper stage surface and a lower stage surface, the upper and lower stage surfaces facing in the same direction, the first terminal portion has a stepped shape including an upper stage portion formed on the upper stage surface and a lower stage portion formed on the lower stage surface, the upper stage portion has a first terminal surface contacting, the terminal section of the coil, and the lower stage portion has a second terminal surface positioned on an extension line of the terminal section of the coil and not contacting the terminal section of the coil.

2. The coil component as claimed in claim 1, wherein the base has a second surface substantially perpendicular to the first surface, the terminal electrode is formed into an L-shape and has a second terminal portion printed on the second surface of the base, and the second terminal portion is connected to the lower stage portion of the first terminal portion.

3. The coil component as claimed in claim 1, wherein the base is a drum core having a winding core around which the coil is wound and a pair of flanges provided, at both ends of the winding core, and the terminal electrode is formed on each of the flanges.

4. A coil component comprising:

a drum core having a winding core and a flange provided at an end of the winding core, the flange including a first plane having a first height from the winding core and a second plane having, a second height from the winding core, the first height being, greater than the second height, the first and second planes facing in the same direction;

a terminal electrode having a first portion formed on the first plane of the flange and a second portion formed on the second plane of the flange, the first portion having a third height from the winding core, the second portion having a fourth height from the winding core, the third height being greater than the fourth height, the first and second portions facing in the same direction; and a coil wound around the winding core, the coil having a terminal section connected to the first portion of the terminal electrode so that the terminal section is free from contacting the second portion of the terminal electrode.

5. The coil component as claimed in claim 4, wherein the terminal electrode is continuously formed on the first and second planes of the flange.

6. The coil component as claimed in claim 5, wherein the second plane is positioned at an opposite side of the winding core with respect to the first plane.

7. The coil component as claimed in claim 6, wherein the terminal section of the coil is terminated at vicinity of a boundary between the first and second planes.

8. The coil component as claimed in claim 4, wherein the flange further includes a third plane substantially perpendicular to the first and second plane, the terminal electrode is formed on the first, second and third planes of the flange, and the terminal electrode is continuously formed on the first, second and third planes of the flange.

9. The coil component as claimed in claim 4, wherein the terminal electrode is printed on the first and second planes of the flange.

10. A coil component comprising:

a drum core having a winding core and a flange provided at an end of the winding core, the flange including a first plane having a first height from the winding core, a second plane having a second height from the winding core and substantially parallel to the first plan, and a third plane substantially perpendicular to the first and second planes, the first and second planes facing in the same direction, the first height being greater than the second height;

a terminal electrode continuously formed on the first, second and third planes of the flange, the terminal electrode having first, second and third electrodes formed on the first, second and third planes of the flange, respectively, the second electrode being connected between the first and third electrodes, the first electrode having a third height from the winding core, the second electrode having a fourth height from the winding core, the third height being greater than the fourth height, the first and second electrodes facing in the same direction; and a coil wound around the winding core, the coil having a terminal section contacting the first electrode without contacting the second and third electrodes.

11. The coil component as claimed in claim 10, wherein the terminal section of the coil is terminated at vicinity of a boundary between the first and second planes.

12. The coil component as claimed in claim 10, wherein the terminal electrode is printed on the first, second and third planes of the flange.

13. The coil component as claimed in claim 1, wherein the base further has a third surface substantially parallel to the extending direction of the terminal section of the coil, the first and third surfaces being opposite to the each other.

14. The coil component as claimed in claim 13, wherein the third surface is free from the terminal electrode.

15. The coil component as claimed in claim 14, further comprising a plate core connected to the third surface of the base.

16. The coil component as claimed in claim 4, wherein the flange further includes a fourth plane opposite to each of the first and second planes.

17. The coil component as claimed in claim 16, wherein the fourth plane is free from the terminal electrode.

18. The coil component as claimed in claim 17, further comprising a plate core connected to the fourth plane of the drum core.

19. The coil component as claimed, in claim 10, wherein the flange further includes a fourth plane opposite to each of the first and second planes.

20. The coil component as claimed in claim 19, wherein the fourth plane is free from the terminal electrode.

21. The coil component as claimed in claim 20, further comprising a plate core connected to the fourth plane of the drum core.

* * * * *